United States Patent [19]

Smith

[11] Patent Number: 4,884,921

[45] Date of Patent: Dec. 5, 1989

[54] RETAINING WALL MODULE HAVING FACE PANEL AND T-STEM WITH MEANS FOR RECEIVING TRANSVERSE STABILIZING WEB

[75] Inventor: Peter J. Smith, Gansevoort, N.Y.

[73] Assignee: Fomico International, Inc., Fort Edward, N.Y.

[21] Appl. No.: 244,684

[22] Filed: Sep. 15, 1988

[51] Int. Cl.[4] ..... E02D 29/02

[52] U.S. Cl. ..... 405/286; 405/258

[58] Field of Search ..... 405/258, 262, 272, 284, 405/285, 286, 287; 52/608, 610, 611

[56] References Cited

U.S. PATENT DOCUMENTS

| | | | |
|---|---|---|---|
| 4,000,622 | 1/1977 | Chiaves | 405/286 |
| 4,343,572 | 8/1982 | Hilfiker | 405/282 |
| 4,449,858 | 5/1984 | Hynds | 405/286 |
| 4,592,678 | 6/1986 | McNinch, Jr. et al. | 405/284 |
| 4,616,959 | 10/1986 | Hilfiker | 405/286 |
| 4,655,646 | 4/1987 | Babcock et al. | 405/286 |
| 4,684,294 | 8/1987 | O'Neill | 405/286 |

*Primary Examiner*—David H. Corbin

*Attorney, Agent, or Firm*—Kenyon & Kenyon

[57] ABSTRACT

Precast concrete modules for stacked assembly into a retaining wall have rectangular face panels and single retaining stems connected to rear faces of the face panels. Each retaining stem includes a slot or other device for receiving a stabilizing web that extends transversely between the stems of modules arranged side-by-side in a horizontal row. The single retaining stem of each module may be connected to the rear face of the module at a location spaced from one side edge of the face panel by one quarter of the distance between opposite side edge of the panel. A retaining wall assembly includes modules stacked in successive courses, with the face panels being staggered in adjacent courses to create a "brick bonded" stack, and with the retaining stems of modules in successive courses being superposed in vertical alignment.

9 Claims, 6 Drawing Sheets face 69, the rear face containing a rectangular indentation 70 to reduce the weight. As in the first three embodiments, the front panel has a top edge 71 and one side edge 72 provided with front lips 73 and 74, respectively, and a bottom edge 75 and other side edge 76 provided with front notches 77 and 78, respectively. The retaining stem 67 has side faces 79 and 80, a top surface 81, a bottom surface 82, a front end 83, and a rear end 84. A stabilizing web receiving slot 85 is located below a large rectangular opening 86 that is provided to reduce the weight of the retaining stem. The opening 86 also facilitates lifting the module.

Preferably, at least one hole 87 is provided in the top surface of the retaining stem and a corresponding hole 88 in the bottom surface to receive a nylon coated steel pin (not shown). The pin helps to locate the modules of successive courses and also acts as a shear key.

A variation of the fifth embodiment is shown in FIGS. 17–20, with the same features as in FIGS. 13–16 having the same reference numerals. This embodiment incorporates the face panel top and bottom edge details of FIGS. 11 and 12. Specifically, the top and bottom edges 91, 92 of the face panel are plain, while the right and left side edges remain substantially the same as in the fifth embodiment. In addition, the opening 86 is reduced in height from that in the fifth embodiment to provide room for a second web-receiving slot 93. These changes result in a universal unit that will satisfy the alternating left hand and right hand requirements of an assembled retaining wall. As mentioned in connection with the fourth embodiment of FIG. 11, the ability to use the same element in successive courses of a retaining wall significantly enhances the utility of the module as a commercial product.

The most significant feature of the fifth and sixth embodiments is that, whereas the retaining stems of the previous embodiments were rigidly connected to the face panels, the connecting means between the front end 83 of the retaining stem and the rear face 69 of the module 65 comprises a flexible tensile reinforcing web 89 that creates a hinge joint 90 between the face panel and the retaining stem. The hinge joint enables the module to be cast in a flat mold and allows the retaining stem to swing from a position parallel to the face panel, for space saving storage and transport, to a position substantially perpendicular to the face panel, for assembly in a retaining wall. The cost of a flat mold is considerably less than that of a conventional rigid mold. In addition, the flat mold allows provision of an accurate mold finish to the top and bottom mating edges of the face panels and stems. A further advantage of a flat mold is that it facilitates the use of a form liner that molds the concrete face into various textures, such as that of natural stone.

The hinged connection between the retaining stem and the face panel also permits angular adjustment between the two elements. This is especially useful when the modules are used to build a curved retaining wall, particularly a convex wall of relatively small radius, to avoid interference between retaining stems of adjacent modules. The material of the reinforcing web can be the same polymeric grid material as is preferred for the stabilizing web, or it can be a conventional wire mesh grid.

The steps for erecting a retaining wall using the modules of the invention are as follows. After necessary excavation, front and rear footings similar to those shown in FIG. 6 are poured, the footings extending for the intended length of the wall. The modules of a first course are then set side by side on the footings, either by a crane or, if light enough, by hand. The single stem design of the modules makes them easy to set in place because there is free access and plenty of room around the rear of the panels. If the stems are connected to the face panel at the preferred quarter point location, care must be taken that all of the stems are near the same side edge, left or right, for the modules in a given course. If extra wall stability is desired for certain soil conditions, the rear ends of the retaining stems can be fastened to screw anchors that have been embedded in the ground behind the rear footing.

When the modules of the first course are in position, the shear keys, if used, should be fitted into the mating indentations in the top surfaces of the retaining stems, and then the stabilizing web or webs should be threaded through the corresponding web receiving slots in the retaining stems. The web or webs extending from the outer side faces of the retaining stems of the modules at the two ends of the wall can be suitably secured to the stems, or to wing wall modules (not shown), or otherwise prevented from being drawn back through the slots. The webs also may be secured at each intermediate retaining stem from being drawn through the corresponding slots by any conventional means. Although the open grid pattern of the preferred "Tensar" mat type of webs will allow the backfilling operation to wait until all courses of the retaining wall are in place, it is usually preferable to backfill after each course is set. This assures that the earth is properly compacted around the retaining stem and below and above the stabilizing web. It also eliminates the need for scaffolding as the wall rises.

The next courses are set in the same manner, with the "handedness" of the retaining stems switching from one side to the other for each successive course, so that the stems of each course will lie directly on the stems of the preceding course when the face panels are offset in "brick wall" fashion. Half length panel modules will be needed at alternate ends to produce plumb ends of the retaining wall, as explained above in connection with the discussion of FIGS. 5 and 6. If top edges of the face panels are provided with the optional front lip described in connection with some of the embodiments, the top course may be finished off with a notched coping (not shown), if desired.

From the foregoing description, it will be apparent that the retaining wall modules of the present invention are simple to fabricate, easy to erect, light in weight relative to their retaining ability, and that they will create a strong, stable, and enduring retaining wall for a minimal cost of material and labor.

I claim:

1. A precast concrete module for constructing a retaining wall, the module including:

a face panel having a front face, a rear face, side edges, a top edge, and a bottom edge;

a single retaining stem having opposite side faces, a front end, a rear end, a top surface, and a bottom surface parallel to the top surface; and means connecting the front end of the retaining stem to the rear face of the face panel, wherein the improvement comprises:

the front end of the retaining stem being connected to the rear face of the face panel at a location spaced from one side edge of the face panel by one quarter modules illustrated in FIG. 5 permits the face panel of the modules of each course to be staggered relative to the face panels in the courses immediately above and below, while the retaining stems are vertically aligned from course to course. The resulting "brick bonded" assembly combines lateral and longitudinal strength, stability, and rigidity, without requiring any additional elements, other than half size filler panels 34, with central retaining stems, to even up the ends of the wall. To provide full-width wing walls, it usually will be desirable that the stems of the modules at each end of the wall in every course have the same length, instead of reducing the stem lengths of the modules in the upper courses as shown in FIG. 6.

FIG. 6 also illustrates how the front notch in the lower edge of each face panel fits against the front lip on the upper edge of the face panel in the course below, or against a lip 36 at the front of a footing 37 that is cast at the construction site to carry the face panels of the first course of modules. The same footing extends to the rear ends of the retaining stems of the first course of modules to support the stems along their full lengths. The "lip and notch" interengagement of the top, bottom, and side edges of the face panels locates the panels to produce a flush front face for the wall. In addition, the lapped edges act to seal the joints between panels against penetration by water or soil. The lips and notches are not normally intended to withstand horizontal shear stresses between modules, this function being performed by friction between the retaining stems augmented, as necessary, by shear keys.

FIGS. 7 and 8 illustrate a wall assembly of modules representing a second embodiment of the invention. Elements that are the same as corresponding elements in the first embodiment previously described are identified by the same reference numerals as before.

The face panel 11 of the second embodiment is identical to the face panel of the first embodiment, but the retaining stem 39 differs by having an upper slot 40 as well as a lower slot 41 for receiving stabilizing webs 42 and 43, and by adding semicircular indentations 44 and 45 in the upper surface 46 and the lower surface 47, respectively, of the retaining stem. These indentations hold a cylindrical shear key 48 provided with circular flanges 49 at each end (see FIG. 8). The shear key locks two superposed modules against relative movement both forward and rearward and side to side, providing additional stability to the assembly. Yet the shear key is relatively small and lightweight; it can be lifted and set into the upper indentation 44 easily by one man as each module is set in place. The key then serves as a guide for the retaining of a module in the next course.

The stabilizing webs 42 and 43 are shown in outline form to avoid confusing detail. They preferably are high tensile strength polymer grids, such as are sold under the trademark "Tensar" by the Tensar Corporation of Seattle, Wash. Other flexible web materials having the needed strength and corrosion resistant properties can be used, if desired. For example, a welded grid of steel wires could be used, or even a flexible steel sheet when the backfilled soil is sandy and would tend to sift through an open grid web. If steel is used for the web, it should be protected against corrosion by galvanizing or plastic coating.

A comparison of FIG. 6 with FIG. 7 shows that the slots 32 in the former are placed close to the rear face of the face panel, while the slots 40 and 41 are placed close to the rear end of the retaining stem. The number, length, and placement of the slots is a matter of design choice, although it will be clear that placement close to the rear end of the retaining stem results in a greater lever arm for acting against an overturning moment about the bottom edge of the face panel of the module. In any event, it is desirable to provide at least one slot close to the bottom surface of the retaining stem so that a maximum depth of earth backfill will be placed above it. This is especially important for the modules in the top course of a retaining wall.

In a third embodiment, illustrated by FIG. 9, the upper semicircular indentations of the second embodiment are replaced by a pair of rectangular indentations 50, 51, and the lower semicircular indentations are replaced by a corresponding pair of rectangular indentations 52, 53. These rectangular indentations accommodate rectangular shear keys (not shown) that are otherwise similar to the flanged cylindrical shear keys of the second embodiment and which perform the same function.

In all of the first three illustrated embodiments the face panels are identical, having front lips on the top and one side edge and front notches on the bottom and other side edge. FIG. 10 shows the overlapping sealed joint obtained by this arrangement.

FIG. 11 illustrates a fourth embodiment of a module, as incorporated into a retaining wall assembly. In this embodiment, the retaining stems 54 of the right hand stem modules 55 and the left hand stem modules 56 are similar in design to those of the third embodiment, except for having only a single web receiving slot 57 located midway between the top and bottom surfaces of the stem, but the face panels 58 differ from those of the previous embodiments. The top edge 59, bottom edge 60, and one side edge 61 are squared and flat. At the other side edge 62, a backing flange 63 extends rearwardly from the rear face 64 and outwardly from the side edge 62. When two modules are placed side by side, with one side edge 61 of one module abutting the other side edge 62 of the other module, the backing flange 63 provides a sealed joint, as illustrated by the detail view of FIG. 12.

The face panel of the fourth embodiment of FIG. 11 is simpler to fabricate and less subject to damage during transit and installation than the face panels of the previously described embodiments, but it does not provide as positive an interengagement or as good sealing between all of the joints. The former drawback can be remedied by providing two shear keys in the rectangular indentations of each retaining stem. The latter drawback can be overcome by placing elastomeric strips or rods (not shown) along each joint, either directly on the flat edges or in grooves (not shown) in the edges.

Although the modules in FIG. 11 are shown in both right hand stem and left hand stem versions, it should be clear that the same modules can be used in successive courses by rotating the panels by 180 degrees to reverse the "handedness" of the retaining stem. Thus, the fourth embodiment provides a potential savings in inventory and reduces the problems of planning and ordering for a specific job.

FIGS. 13–16 show a fifth embodiment of a module according to the invention which is particularly advantageous for smaller size modules intended to be installed without the need for lifting cranes or for larger size modules installed on a radius. The module 65 shown in these Figures includes a face panel 66 and a retaining stem 67. The face panel has a front face 68 and a rear The above and other features and advantages will be described in more detail in connection with the accompanying drawings which show several preferred embodiments of modules and of retaining wall assemblies according to the invention.

DETAILED DESCRIPTION OF THE PREFERRED EMBODIMENTS

Figure 2:
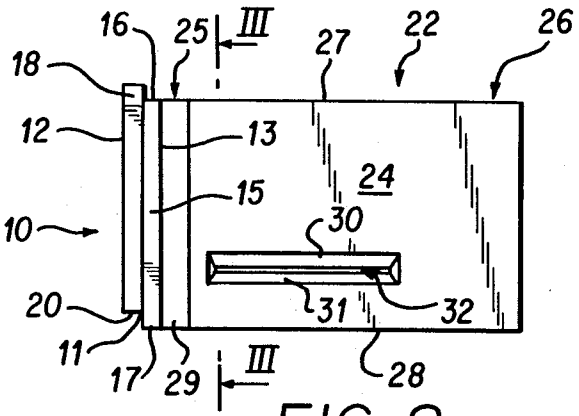
FIG. 2 is a left side elevation view of the module of FIG. 1.
Figure 4:
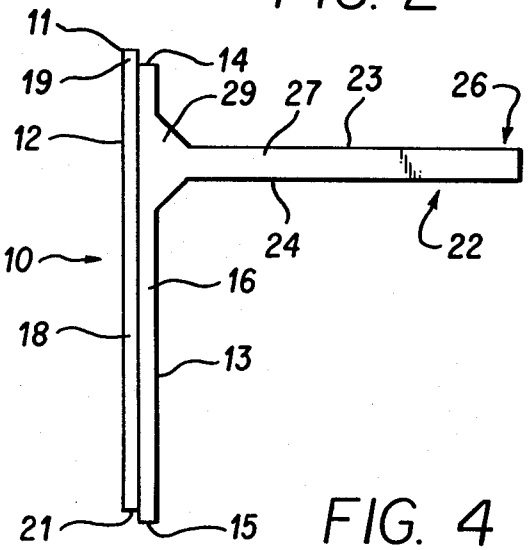
FIG. 4 is a top plan view of the module of FIG. 1.
Figure 1:
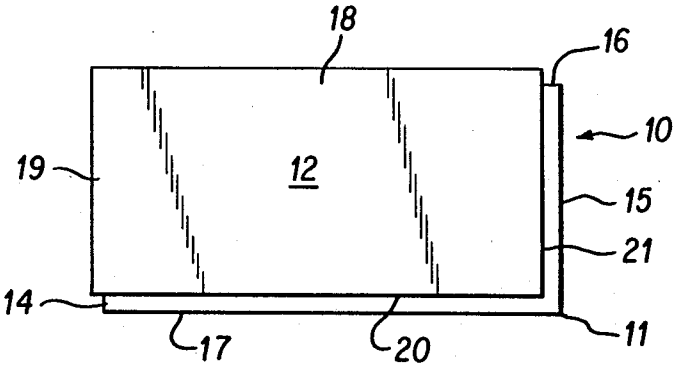
FIG. 1 is a front elevation view of a first preferred embodiment of a precast concrete module for a retaining wall assembly according to the invention.

With reference to FIGS. 1–6, a first embodiment of a precast concrete module 10 according to the invention includes a face panel 11 having a front face 12, a rear face 13, side edges 14, 15, a top edge 16, and a bottom edge 17 that is parallel to the top edge. A top front lip 18 extends from the top edge 16, and a right side front lip 19 extends from the right side edge 14 of the panel. A lower front notch 20 and a left side notch 21 of corresponding dimensions are formed in the bottom and left side edges of the panel, respectively. These lips and notches locate each face panel with mating notches and lips, respectively of adjacent panels when a plurality of modules are stacked in courses to form a retaining wall assembly, as will be explained in detail below.

A retaining stem 22 extends from the rear face 13 of the face panel. The retaining stem has opposite side faces 23, 24, a front end 25, a rear end 26, a top surface 27, and a bottom surface 28. In this embodiment, the retaining stem is formed integrally with the face panel and connects rigidly to the face panel by means of an enlarged or fillet portion 29 to provide adequate strength against fracture at the junction between the front end of the retaining stem and the rear face of the face panel.

Figure 7:
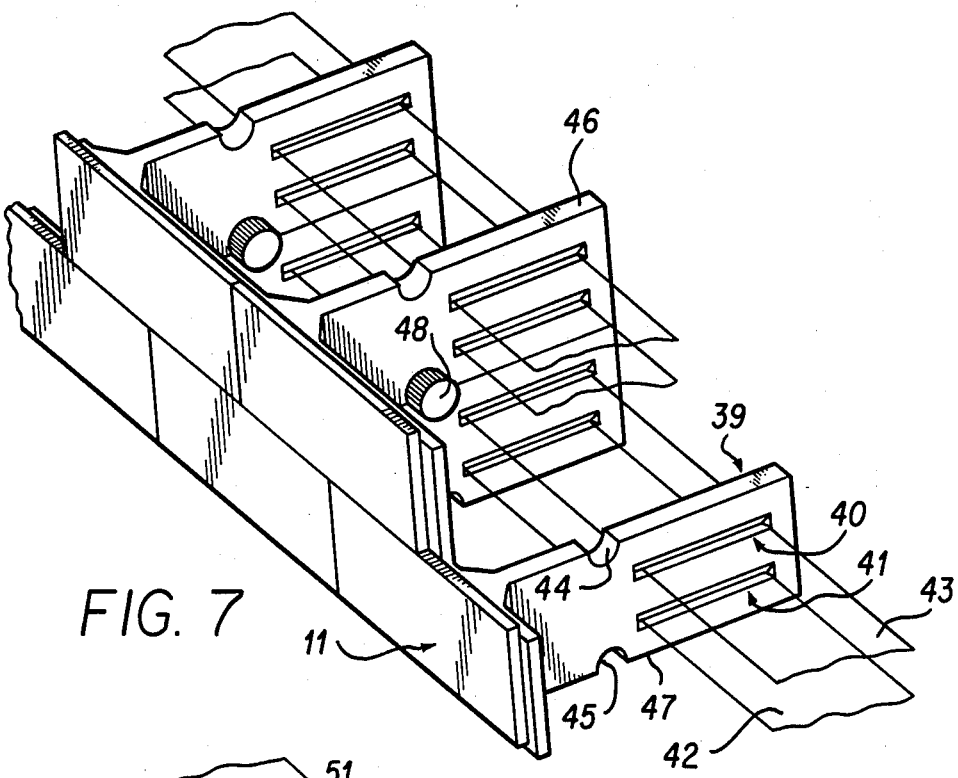
FIG. 7 is a top perspective view of a partial retaining wall assembly of a second embodiment of precast concrete modules according to the invention.
Figure 9:
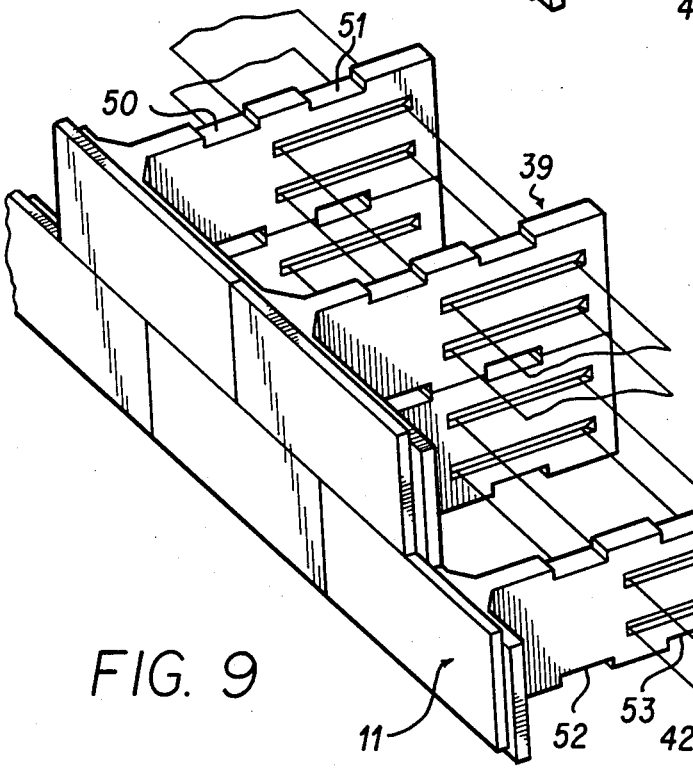
FIG. 9 is a top perspective view of a partial retaining wall assembly of a third embodiment of precast concrete modules according to the invention.
Figure 8:
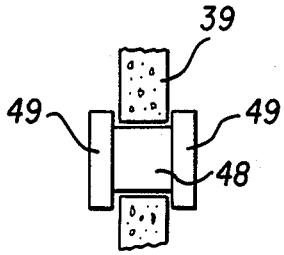
FIG. 8 is an enlarged detailed view, in partial cross section, of a shear key and surrounding structure taken along the line between arrows VIII—VIII in the embodiment of FIG. 7.
Figure 10:
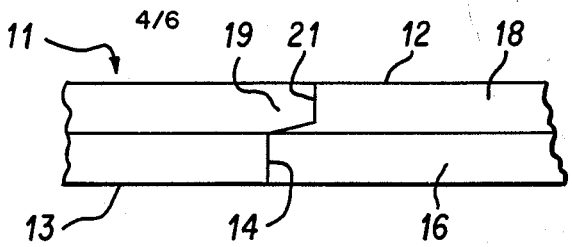
FIG. 10 is an enlarged partial detail top plan view of a vertical joint between adjacent face panels of the modules shown in FIGS. 1–9.
Figure 11:
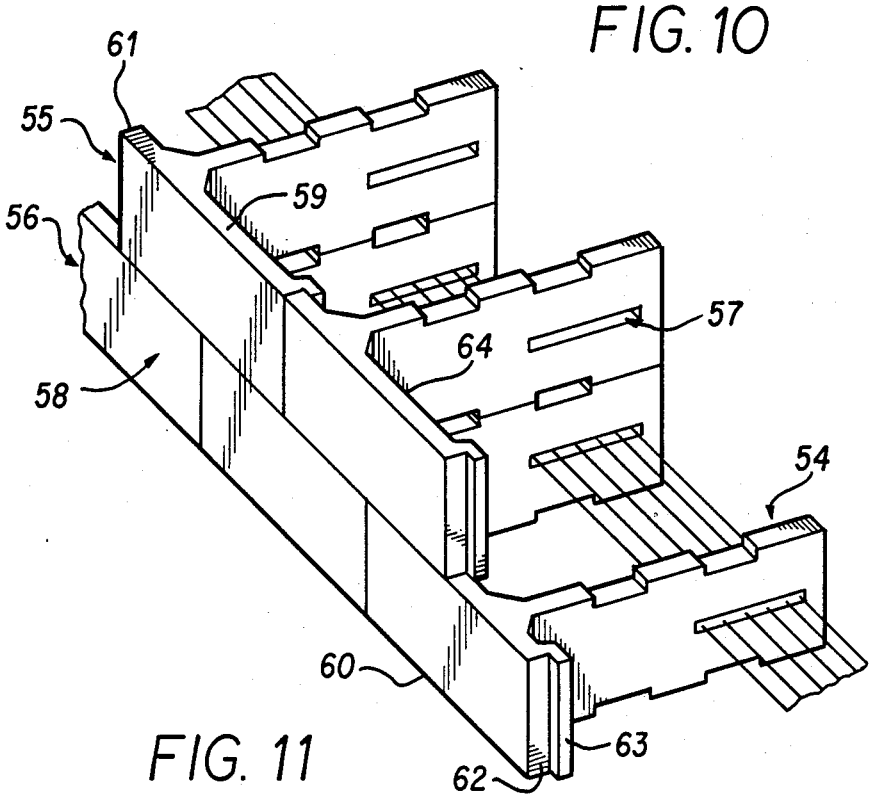
FIG. 11 is a top perspective view of a partial retaining wall assembly of a fourth embodiment of precast concrete modules according to the invention.
Figure 12:
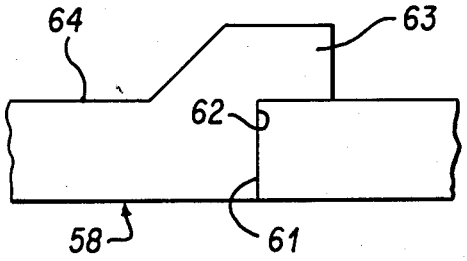
FIG. 12 is an enlarged partial detail top plan view of a vertical joint between adjacent face panels of the modules shown in FIG. 11.
Figure 14:
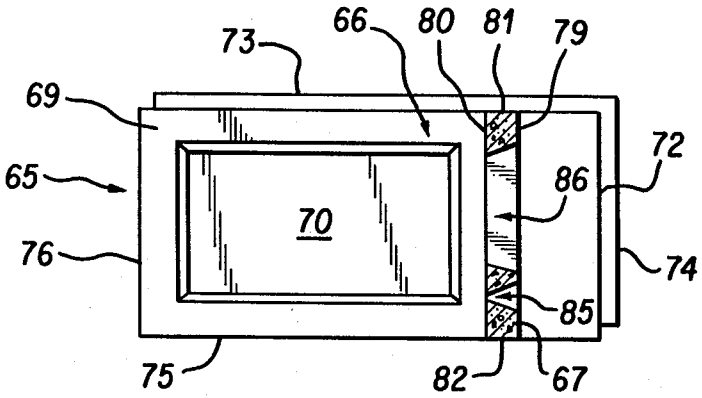
FIG. 14 is a rear elevation view, partly in cross section, of the fifth embodiment of the module taken along the line between arrows XIV-XIV of FIG. 13.
Figure 16:
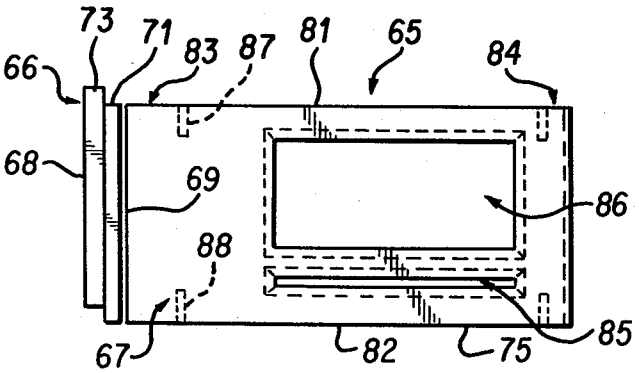
FIG. 16 is a left side elevation view of the module of FIG. 13.
Figure 13:
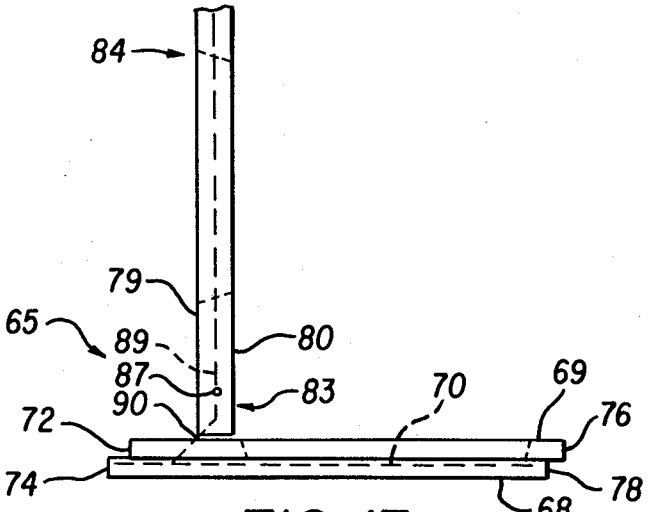
FIG. 13 is a top plan view of a fifth embodiment of a precast concrete module for a retaining wall assembly according to the invention.
Figure 15:
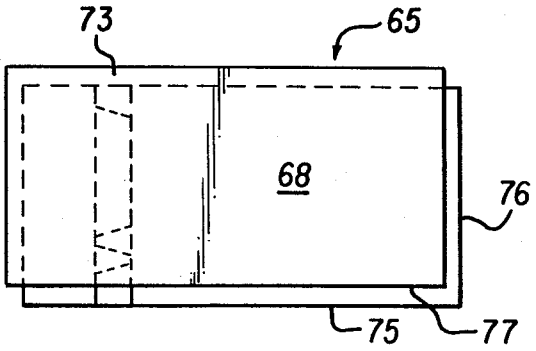
FIG. 15 is a front elevation view of the module of FIG. 13.
Figure 18:
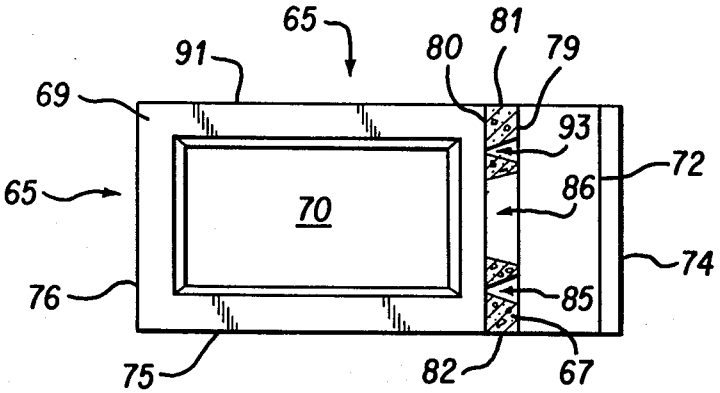
FIGS. 17 through 20 correspond respectively to FIGS. 13–17 and show a sixth embodiment that is a variant of the embodiment shown in FIGS. 13–16.
Figure 17:
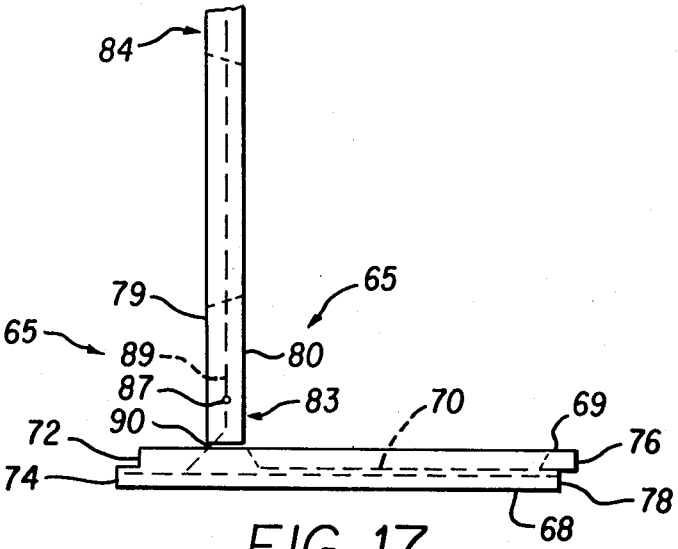
Figure 20:
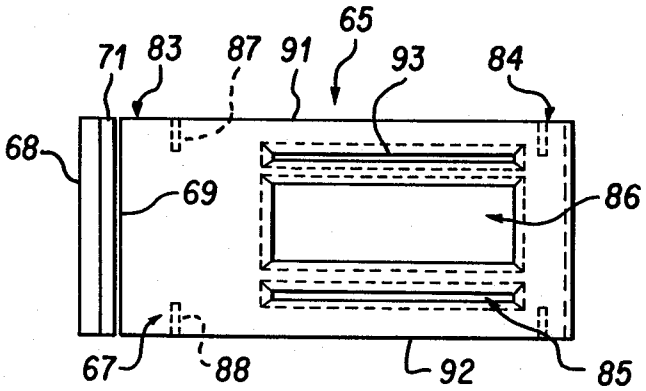
Figure 19:
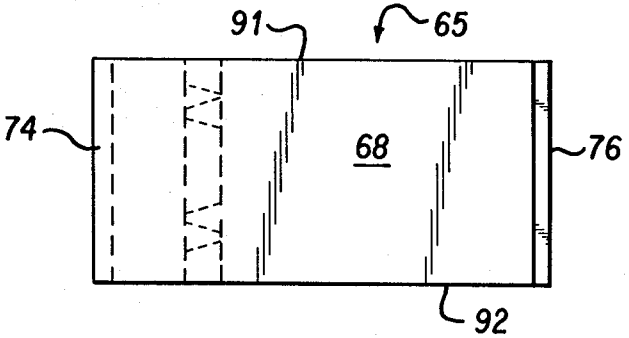

A principal feature of the retaining wall module of this invention is that the retaining stem 22 is provided with means for receiving stabilizing webs that extend laterally between retaining stems of modules in each course to produce a retaining wall assembly having a high stability-to-weight ratio and a high stability-to-stem-length ratio. In the illustrated embodiment, this receiving means comprises a pair of closely spaced facing interior surfaces 30, 31 extending laterally from one side face 23 to the opposite side face 24 of the retaining stem 22 and extending longitudinally in spaced relation to the top and bottom surfaces 27, 28 of the retaining stem, each pair of said facing interior surfaces defining a narrow elongated slot 32 for receiving a stabilizing web 33 of material (see also FIGS. 7, 9, and 11) passing transversely through corresponding slots in the retaining stems of other modules in a horizontal row of modules. As will be explained in more detail below, the stabilizing web serves to translate the mass of earth backfill above it into a vertical force acting downwardly on the retaining stem to counteract the overturning force exerted by the earth backfill against the rear face of the face panel.

Figure 3:
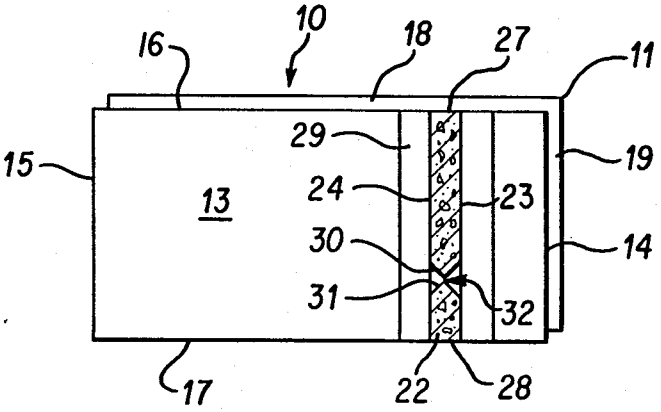
FIG. 3 is a rear elevation view, partly in cross section, of the module of FIG. 1 taken along the line between arrows III—III of FIG. 2.

As shown most clearly in FIG. 3, each of the interior surfaces 30, 31 is V-shaped in cross section, thereby providing an expanded slot opening on each side of the retaining stem for easy insertion of a stabilizing web.

Another important feature of the module embodiment of FIGS. 1–4 is that the retaining stem is connected to the rear face of the face panel at a location spaced from one side edge (the right edge in FIGS. 3 and 4) by one quarter of the distance between the two side edges of the panel. The stem can be attached equally well at a location one quarter of the side-to-side distance from the left hand edge of the panel. In fact, for reasons explained in connection with the discussion of FIGS. 5 and 6 below, it is desirable to make both left hand stem and right hand stem versions when the face panels have differently configured top and bottom edges.

Figure 6:
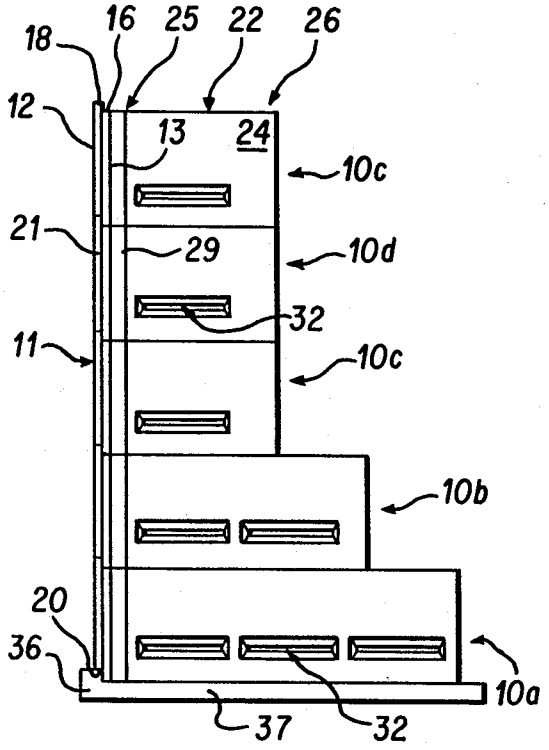
FIG. 6 is a left side elevation view of the retaining wall assembly of FIG. 5.
Figure 5:
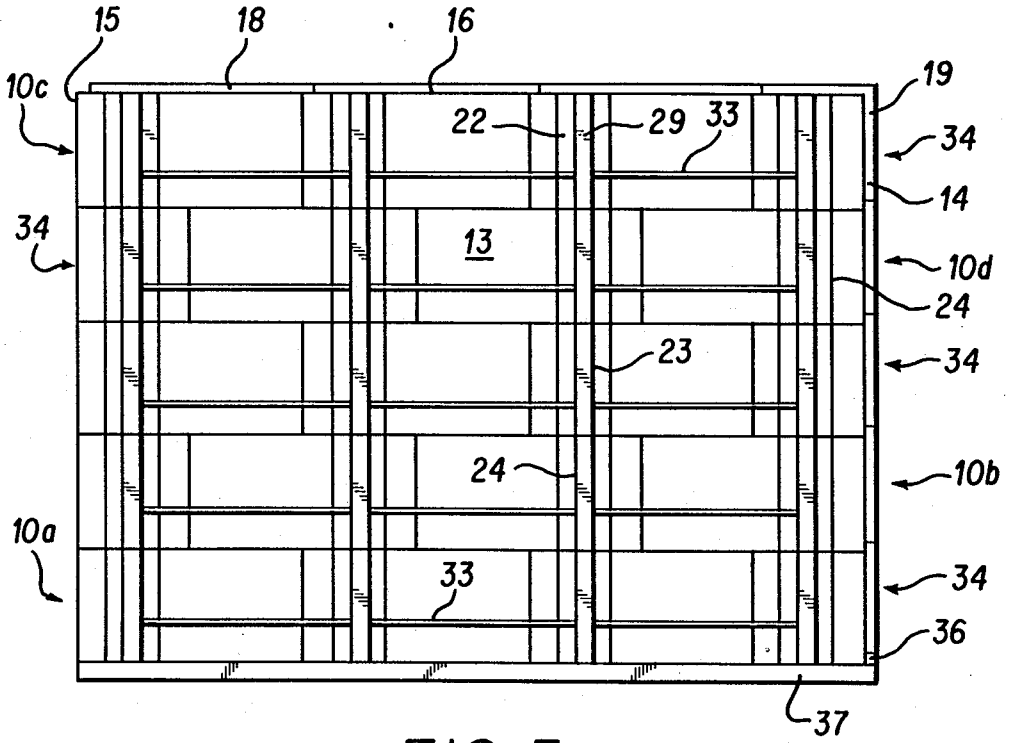
FIG. 5 is a rear elevation view of a retaining wall assembly composed of alternate courses of left hand stem and right hand stem modules.

FIGS. 5 and 6 show a retaining wall assembly of stacked left hand stem and right hand stem versions of the modules of FIGS. 1–4. The rear view of the wall illustrated by FIG. 5 shows left hand stem modules **10*a* in a first horizontal course, right hand stem modules 10*b* in a second course, left hand stem modules 10*c* in third and fifth courses, and right hand stem modules 10*d* in a fourth course. As shown in FIG. 6**, the modules in the several courses may differ not only in the left or right "handedness" of the stem location but also in the length of the stem. The modules in the lower courses have longer stems and more than one slot for additional stabilizing webs to counteract the greater overturning moments exerted on these lower modules.

By employing alternately left hand stem and right hand stem modules in successive courses, the array of

RETAINING WALL MODULE HAVING FACE PANEL AND T-STEM WITH MEANS FOR RECEIVING TRANSVERSE STABILIZING WEB

BACKGROUND OF THE INVENTION

1. Technical Field

This invention relates to precast retaining wall modules and specifically to modules having a face panel and a rearwardly extending retaining stem. The invention also relates to retaining walls assembled with such modules.

2. Background Art

U.S. Pat. No. 4,684,294 of O'Neill discloses a precast concrete retaining wall construction element having a rectangular face panel and an integral embedment beam. The embedment beam extends perpendicularly from the center of the rear surface of the face panel, so that the element is T-shaped in plan view.

The embedment beam has indentations in its side surfaces to increase frictional engagement with earth backfill, and a sloping rear edge of the embedment beam is provided with a V-shaped groove or a sawtooth profile for the same purpose. A front lip on the upper edge of a face panel of one element engages a corresponding notch in the lower edge of the face panel of an element stacked on top, to key the two elements together.

The elements of U.S. Pat. No. 4,684,294 can be assembled in adjacent vertical "stack bonded" columns with the embedment beam of each course resting on the embedment beam of the element below. A drawback to this arrangement is that there is no interengagement between the elements of adjacent columns. The elements also can be assembled in a staggered "brick bonded" array, but this requires separate shear key beams extending across the embedment beams of each course for the embedment beams of the staggered elements of the next course to rest on.

Although the indentations and other means for increasing frictional engagement with the earth backfill increase the resistance of an assembly of these elements to overturning forces exerted by the backfill, this increased resistance is small compared with that obtainable from the total mass of earth backfilled between the embedment beams.

Another arrangement for anchoring face elements of a retaining wall are disclosed in U.S. Pat. Nos. 4,343,572 and No. 4,616,959 of Hilfiker. In the '572 patent a rigid face member is held in place by vertically spaced anchor elements in the form of horizontal wire grids embedded in earth backfill behind the face member. The '959 patent substitutes noncorrodible polymer mats for the wire grids and secures the mats between courses of stacked preformed concrete panels. The restraining force exerted by the mats on the wall members depends on the frictional force developed between the mats and the surrounding earth.

In U.S. Pat. No. 4,592,678 of McNinch, Jr. et al. overturning resistance is supplied to a stacked array of double-T elements by vertical tension rods extending upward from a massive concrete footing through holes near the rear ends of the double stems of the elements. Nuts at threaded upper ends of the tension rods secure the stems to the footing. By having a stem located one quarter of the distance from each end, the face panels of McNinch, Jr. et al. can be stacked in "brick bonded" staggered courses with both stems of each double-T element resting on stems of elements in the course below. Other than through the relatively low frictional force between their smooth faces and the surrounding backfill, however, the double stems of these elements do not take advantage of the mass of the backfill material to resist the overturning force exerted of the backfill.

SUMMARY OF THE INVENTION

The present invention provides a retaining wall system incorporating precast concrete face panel and retaining stem modules that are simple to fabricate, that can be stacked in stable courses of staggered panels, and that through means for receiving stabilizing webs extending laterally between retaining stems of modules in each course will produce a retaining wall having a high stability-to-weight ratio and a high stability-to-stem length ratio.

In particular, the present invention includes a precast concrete module for constructing a retaining wall, the module including:

a face panel having a front face, a rear face, side edges, a top edge, and a bottom edge;

a single retaining stem having opposite side faces, a front end, a rear end, a top surface, and a bottom surface parallel to the top surface; and means connecting the front end of the retaining stem to the rear face of the face panel, wherein the improvement comprises:

the retaining stem having means for receiving a stabilizing web of material extending transversely between the retaining stems of a horizontal row of such modules assembled into a retaining wall.

Preferably, the means for receiving a stabilizing web comprises at least one pair of closely spaced facing interior surfaces extending laterally from one side face to the opposite side face of the retaining stem and extending longitudinally in spaced relation to the top and bottom surfaces of the retaining stem, each pair of said facing interior surfaces defining a narrow elongated slot for receiving a stabilizing web of material passing transversely through corresponding slots in the retaining stems of the horizontal row of modules.

The retaining stem may be formed integrally with the face panel to create a rigid T-shaped module, with the means connecting the front end to the retaining stem to the rear face of the face panel comprising a widened transition portion or fillet for added strength. Alternatively, the front end of the retaining stem may be connected to the rear face of the face panel by a flexible tensile reinforcing web to create a hinge joint between the face panel and the retaining stem. This latter arrangement is desirable in that it permits the use of a cheaper mold and simplifies the casting procedure. It also reduces the space required for storage and transport of the modules.

It is particularly desirable also to connect the retaining stem to the rear face of the face panel at a location spaced from one of the side edges of the panel by one quarter of the distance from the one side edge to the other side edge rather than at a location spaced equally from the two side edges. By offsetting the stem to a quarter distance from either side edge, successive courses of left hand and right hand stem modules can be stacked with the face panels staggered but the with the retaining stems vertically aligned. This produces a stable array without the need for transverse beams between each course.

of the distance between the one side edges and the other side edge of the face panel.

2. A precast concrete module according to claim 1 wherein the retaining stem has means for receiving a thin flexible stabilizing web of material extending transversely between the retaining stems of a horizontal row of such modules assembled into a retaining wall, the means for receiving a stabilizing web comprising at least one pair of closely spaced facing interior surfaces extending laterally from one side face to the opposite side face of the retaining stem and extending longitudinally in spaced relation to the top and bottom surfaces of the retaining stem, each pair of said facing interior surfaces defining a narrow elongated slot for receiving a stabilizing web of material passing transversely through corresponding slots in the retaining stems of the horizontal row of modules.

3. A precast concrete module according to claim 1 wherein the retaining stem is formed integrally with the face panel to create a rigid T-shaped module, and the means connected to front end of the retaining stem to the rear face of the face panel comprises a widened transition portion between the front end of the retaining stem and the rear face of the face panel.

4. A precast concrete module for constructing a retaining wall, the module including:

a face panel having a front face, a rear face, side edges, a top edge, and a bottom edge;

a single retaining stem having opposite side faces, a front end, a rear end, a top surface, and a bottom surface parallel to the top surface; and means connecting the front end of the retaining stem to the rear face of the face panel, wherein the improvement comprises:

the retaining stem having means for receiving a stabilizing web of material extending transversely between the retaining stems of a horizontal row of such modules assembled into a retaining wall, and the means connecting the front end of the retaining stem to the rear face of the face panel comprising a flexible tensile reinforcing web imbedded in both the retaining stem and the face panel and forming a hinge joint between the rear face of the panel and the front end of the retaining stem.

5. A retaining wall assembly comprising:

an array of a plurality of precast concrete modules arranged in at least two horizontal courses of side-by-side modules, each module including:

a face panel having a first face, a rear face, side edges, a top edge, and a bottom edge;

a single retaining stem having opposite side faces, a front end, a rear end, a top surface, and a bottom surface parallel to the top surface; and means connecting the front end of the retaining stem to the rear face of the face panel at a location spaced from one side edge of the module by one quarter of the distance from the one side edge to the other side edge of the module; and wherein the retaining stems of modules in successive courses of the assembly alternate from being adjacent to left side edges of the face panels in one course to being adjacent to right side edges of the face panels in an adjacent course, and the retaining stems of modules in successive courses are vertically aligned.

6. A retaining wall assembly according to claim 5 wherein the top and bottom surfaces of the retaining stem of each module have mating indentations, and the assembly further comprises shear keys inserted into each pair of mating indentations of superposed retaining stems of modules in adjacent courses.

7. A retaining wall assembly according to claim 6 wherein each shear key comprises a center portion that fits within the mating indentations of superposed retaining stems and enlarged and portions that lie closely adjacent to the side faces of the superposed retaining stems.

8. A retaining wall assembly according to claim 5 wherein the modules in one course are identical to the modules in the next course, with the face panels of the modules in the next course being rotated by 180 degrees with respect to the face panels in the one course.

9. A precast concrete module for constructing a retaining wall, the module including:

a face panel having a front face, a rear face, side edges, a top edge, and a bottom edge;

a single retaining stem having opposite side faces, a front end, a rear end, a top surface, and a bottom surface parallel to the top surface, the retaining stem having means for receiving a stabilizing web of material extending transversely between the retaining stems of a horizontal row of such modules assembled into a retaining wall; and means connecting the front end of the retaining stem to the rear face of the face panel at a location spaced from one side edge of the face panel by one quarter of the distance between the one side edge and the other side edge of the face panel, the connecting means comprising a flexible tensile reinforcing web imbedded in both the retaining stem and the face panel and forming a hinge joint between the rear face of the panel and the front end of the retaining stem.

* * * * *